US011787580B2

(12) United States Patent
Brozell et al.

(10) Patent No.: US 11,787,580 B2
(45) Date of Patent: Oct. 17, 2023

(54) SEALING FOIL LINERS TO CONTAINERS

(71) Applicant: Owens-Brockway Glass Container Inc., Perrysburg, OH (US)

(72) Inventors: Brian J. Brozell, Maumee, OH (US); Brian J. Chisholm, Sylvania, OH (US); Joseph E. Olsavsky, Waterville, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 972 days.

(21) Appl. No.: 16/416,474

(22) Filed: May 20, 2019

(65) Prior Publication Data

US 2019/0270530 A1 Sep. 5, 2019

Related U.S. Application Data

(62) Division of application No. 14/645,531, filed on Mar. 12, 2015, now Pat. No. 10,343,797.

(51) Int. Cl.
*B65B 7/28* (2006.01)
*B65B 7/16* (2006.01)

(52) U.S. Cl.
CPC ..... *B65B 7/2878* (2013.01); *B65B 7/164* (2013.01)

(58) Field of Classification Search
USPC ..... 53/478, 578
See application file for complete search history.

(56) References Cited

U.S. PATENT DOCUMENTS 3,481,100 A * 12/1969 Bergstrom ..... B65B 31/021 53/433
3,492,773 A 2/1970 Bergstrom
3,660,965 A 5/1972 Morera
3,701,234 A 10/1972 Sternau
(Continued)

FOREIGN PATENT DOCUMENTS

AU 2016144725 A1 9/2016
EP 0059299 A1 9/1982
(Continued)

OTHER PUBLICATIONS

New Zealand Patent Examination Report 1, Application No. 733853, Title: Sealing Foil Liners to Containers, Applicant Dwens-Brockway Glass Container Inc., Date of Report: Feb. 4, 2021.
(Continued)

*Primary Examiner* — Sameh Tawfik

(57) ABSTRACT

An apparatus for sealing a foil liner to a container. The apparatus comprises a seal head that includes a body having a first end, a second end, and an axis extending through the first and second ends. The body further includes a sealing surface at the second end thereof facing away from the first end. The seal head further includes fluid path(s) for passing fluid through and out of the seal head and onto the foil liner. A method for sealing a foil liner to a container is also provided wherein a sealing surface of a seal head is aligned with a sealing surface of the container, wherein a peripheral edge of the foil liner is disposed between the sealing surfaces of the seal head and the container. Fluid is then passed through fluid path(s) in the seal head and out of the seal head and onto the foil liner.

10 Claims, 5 Drawing Sheets

(56) References Cited

U.S. PATENT DOCUMENTS 3,969,455 A * 7/1976 Moller ..... B29C 49/02 264/516
4,095,390 A 6/1978 Knudsen
4,217,156 A 8/1980 Slungaard et al.
4,282,699 A * 8/1981 Embro, Jr. ..... B29C 65/18 53/298
4,312,171 A 1/1982 Vadas
4,396,655 A 8/1983 Graham et al.
4,511,426 A 4/1985 Linner
4,707,213 A 11/1987 Mohr et al.
4,870,800 A 10/1989 Kasai
4,982,555 A * 1/1991 Ingemann ..... B65B 31/028 53/405
4,994,637 A * 2/1991 Fang ..... B29C 66/80 156/272.4
5,032,213 A 7/1991 Thomas, Jr.
5,109,653 A 5/1992 Kubis et al.
5,115,938 A * 5/1992 Thompson ..... B29C 65/568 220/DIG. 16
5,157,895 A 10/1992 Shibauchi et al.
5,200,587 A * 4/1993 Fang ..... B29C 65/368 156/274.2
5,238,642 A * 8/1993 Benquet ..... B29C 59/02 264/293
5,305,583 A 4/1994 Linner
5,385,003 A 1/1995 Nixon, Jr. et al.
5,473,860 A * 12/1995 Linner ..... B29C 65/10 53/432
5,718,101 A * 2/1998 Noel ..... B65B 7/164 53/300
6,035,607 A 3/2000 Miller
6,412,252 B1 7/2002 Sarles et al.
6,564,531 B2 * 5/2003 Beck ..... B29C 66/73711 53/485
6,629,399 B2 10/2003 Sarles et al.
6,633,480 B1 10/2003 Herzog
6,637,491 B2 10/2003 Massey et al.
6,713,735 B2 3/2004 Terano
6,732,495 B2 5/2004 Sarles et al.
6,989,518 B2 1/2006 Terano
7,065,941 B2 6/2006 Sarles et al.
7,644,902 B1 1/2010 Julian et al.
7,712,289 B2 * 5/2010 von Seggern ..... B65D 81/2076 53/510
7,735,298 B2 6/2010 Brautigam
7,798,359 B1 9/2010 Marsella
7,841,156 B2 11/2010 Naroska et al.
8,118,074 B2 2/2012 Ferrari et al.
8,407,972 B2 * 4/2013 Gill ..... B29C 66/81457 53/478
9,021,770 B2 5/2015 Krahl et al.
2002/0084027 A1 7/2002 Terano
2002/0184860 A1 12/2002 Sarles et al.
2003/0131568 A1 * 7/2003 Rossi ..... B29C 65/18 53/510
2003/0196412 A1 * 10/2003 Foulke, Jr. ..... B65B 31/028 53/432
2006/0033230 A1 * 2/2006 Chisholm ..... B29C 57/00 264/161
2006/0048480 A1 * 3/2006 Konishi ..... B65B 7/164 53/329.3
2006/0119004 A1 * 6/2006 Chmura ..... B29C 57/12 264/322
2011/0120064 A1 5/2011 Krahl et al.
2012/0324836 A1 12/2012 Miller et al.
2014/0260086 A1 * 9/2014 Schiavina ..... B29C 66/849 53/97
2016/0264270 A1 9/2016 Brozell et al.

FOREIGN PATENT DOCUMENTS

EP 0842854 A2 5/1998
EP 2722281 A2 4/2014
EP 2815983 A1 12/2014
EP 3268284 A1 1/2018

OTHER PUBLICATIONS

PCT International Search Report and Written Opinion, Int. Serial No. PCT/US2016/020832, Int. Filing Date: Mar. 4, 2016, Applicant: Owens-Brockway Glass Container Inc., dated Jun. 21, 2016.
Colombian Office Action No. 13327, CO Patent Application No. NC2017/0008987, dated Dec. 7, 2018.
Brazilian Office Action, Application No. BR112017015901-5, Applicant: Owens-Brockway Glass Container Inc., dated May 11, 2020.

* cited by examiner

SEALING FOIL LINERS TO CONTAINERS

The present disclosure is directed to the sealing of foil liners to containers and, more particularly, to the sealing of foil liners to containers, using, for example, conduction or induction sealing processes.

BACKGROUND AND SUMMARY OF THE DISCLOSURE

Containers, example, glass and plastic containers, often include a base, a finish, and a body extending therebetween. The container finish, in turn, includes a sealing surface to which a removable foil liner may be secured and sealed in order to seal the container. One technique or process that may be used to secure and seal the foil liner to the container sealing surface of the container is a conduction sealing process. In such a process, the foil liner and the sealing surface are heated by a seal head to create an acceptable bond therebetween. Another technique or process that may be used is an induction sealing process. In such a process, the foil liner and the sealing surface are heated as a result of an electromagnetic field that is generated by an induction coil in a sealing head, and an acceptable bond is formed between the foil liner and sealing surface of the container as a result of the heating therebetween. During such processes, however, the generated heat and/or the heat from a hot-filled product within the container may cause the head space of the container (i.e., the area between the contents of the container and the foil liner) to expand and/or the pressure therein to increase, thereby possibly stretching the foil liner causing it to tear or deform resulting in the formation of wrinkles in the foil liner which may detrimentally affect the seal. To account for the head space expansion and/or pressure increase, some containers, for example, certain plastic containers, may include panels sometimes referred to as vacuum panels that are designed to expand as the head space expands and/or the pressure therein increases during the application of heat, and then contract as the head space/pressure decreases following the removal of heat. However, for a container having a relatively rigid structure (e.g., a glass container) that does not allow for such expansion and contraction, the only direction the pressure in the head space can go is up towards the foil liner and, as a result, wrinkles and/or tears may form that create escape paths for the pressure and that detrimentally affect the seal.

A general object of the present disclosure, in accordance with one aspect of the disclosure, is to provide an apparatus and method for sealing that will prevent, or at least minimize, the formation of wrinkles or tears in the foil liner as a result of the sealing of the foil liner to a sealing surface of a container.

The present disclosure embodies a number of aspects that can be implemented separately from, or in combination with, each other.

An apparatus for sealing a foil liner to a sealing surface of a container, in accordance with one aspect of the disclosure, comprises a seal head that includes a body having a first end, a second end opposite the first end, an axis extending through the first and second ends, and an axially-facing sealing surface at the second end of the body facing away from the first end thereof. The seal head further includes one or more fluid paths therein for passing fluid through and out of the seal head and onto at least a portion of the foil liner.

In accordance with another aspect of the disclosure, there is provided an apparatus for sealing a foil liner to a sealing surface of a container comprising a seal head that includes a body having a first end, a second end opposite the first end, an axis extending through the first and second ends, and an axially-facing sealing surface at the second end of the body facing away from the first end thereof. The seal head further comprises a recess in the body at the second end thereof disposed radially-inward of the axially-facing sealing surface, and an inlet passageway and outlet passageway both of which extend through the body and are in fluid communication with the recess. Together, the inlet passageway, outlet passageway, and recess define a fluid path in the seal head for passing fluid through and out of the seal head and onto the foil liner. The seal head still further comprises a facing carried by the body of the seal head and disposed adjacent to the axially-facing sealing surface of the seal head body.

In accordance with a further aspect of the disclosure, there is provided an apparatus for sealing a foil liner to a sealing surface of a container comprising a seal head that includes a body having a first end, a second end opposite the first end, an axis extending through the first and second ends, and an axially-facing sealing surface at the second end of the body facing away from the first end thereof. The seal head further includes an inlet passageway, one or more outlet passageways extending at least partially in an axial direction, and one or more fluid pathways in fluid communication with the inlet passageway and the outlet passageway(s). Together the inlet passageway, outlet passageway(s), and fluid pathway(s) define a fluid path in the seal head for passing fluid through and out of the seal head and onto the foil liner.

In accordance with still a further aspect of the disclosure, there is provided a method of sealing a foil liner to a sealing surface of a container. The method comprises aligning a sealing surface of a seal head with the sealing surface of the container, wherein at least a peripheral edge of the foil liner is disposed between the sealing surfaces of the seal head and container. The method further comprises passing fluid through a fluid path in the seal head and onto the foil liner.

BRIEF DESCRIPTION OF THE DRAWINGS

The disclosure, together with additional objects, features, advantages and aspects thereof, will be best understood from the following description, the appended claims, and the accompanying drawings, in which:

DETAILED DESCRIPTION

Figure 1:
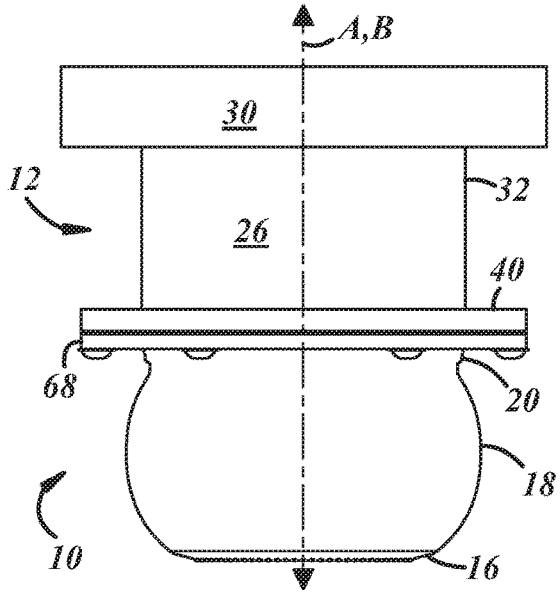
FIG. 1 is an elevational view of a container engaged with an apparatus for sealing a foil liner to the container in accordance with an illustrative embodiment of the present disclosure.

FIG. 1 illustrates a container 10 engaged with an apparatus 12 for sealing a foil liner 14 (FIG. 3) to a sealing surface of the container 10 in accordance with one illustrative embodiment of the present disclosure. The container 10 may be used for packaging any number of goods or products. For instance, the container 10 may be used to package food products, for example and without limitation, pickles, baby food, salsa, peppers, spaghetti sauces, and jams, to cite a few possibilities. The container 10 may also be used to package products other than food products, including, but not limited to, liquids, gels, powders, particles, and the like.

The container 10 may be composed of glass, plastic, or any other material suitable for containing food products that are either cold- or hot-filled, and may comprise a bowl, ajar, or a cup, to cite a few possibilities. With reference to FIG. 1, the container 10 includes a base 16 and a body 18 extending from the base 16, and further includes or defines a longitudinal axis A. In certain embodiments, the container 10 may also include a shoulder (not shown) extending from the body 18 and a neck (not shown) extending from the shoulder or directly from the body 18. In any event, and with reference to FIG. 3, the container 10 further comprises a finish 20 extending axially from the body 18 that includes an open mouth 22 surrounded by a sealing lip or surface 24. The sealing surface 24 is an axially-facing surface that faces away from the container body 18, and is configured to have the foil liner 14 secured and sealed thereto, as will be described below.

Figure 3:
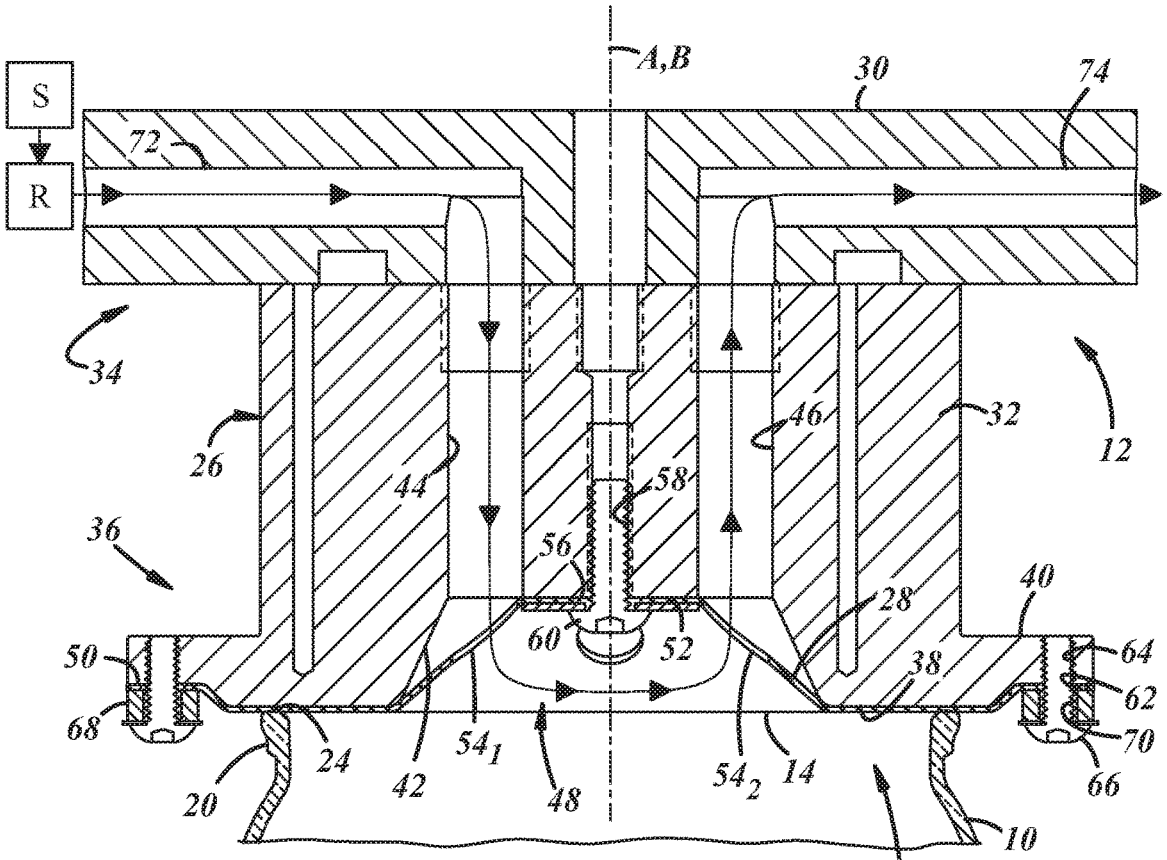
FIG. 3 is a fragmentary sectional view of one illustrative embodiment of the apparatus illustrated in FIG. 1 taken along line 3-3 of FIG. 2.

With continuing reference to FIG. 3, the foil liner 14 is configured to be sealingly and removably coupled to the sealing surface 24 of the container 10, and, in an embodiment, is either conduction or induction sealed to the container sealing surface 24. Accordingly, when, for example, the periphery of the foil liner 14 is secured to the container sealing surface 24, the remainder of the foil liner 14 overlies the mouth 22 of the container and serves to seal the container 10. The foil liner 14 may be composed of any number of materials suitable for hermetically sealing the container 10, and doing so using, for example, one of a conduction or induction sealing technique, including, for example and without limitation, a polymeric material (e.g., plastic).

As briefly described above, the apparatus 12 is for sealing a foil liner to a sealing surface of a container, for example, the sealing surface 24 of the container 10. The apparatus 12 may take a number of forms and may include a number of components. For example, in an illustrative embodiment such as that shown in FIGS. 1-6, the apparatus 12 comprises an apparatus for conduction sealing a foil liner to a sealing surface of a container that may include, for example, a seal head 26, a facing or overlay 28, and an insulating disc 30, to cite a few possibilities.

Figure 2:
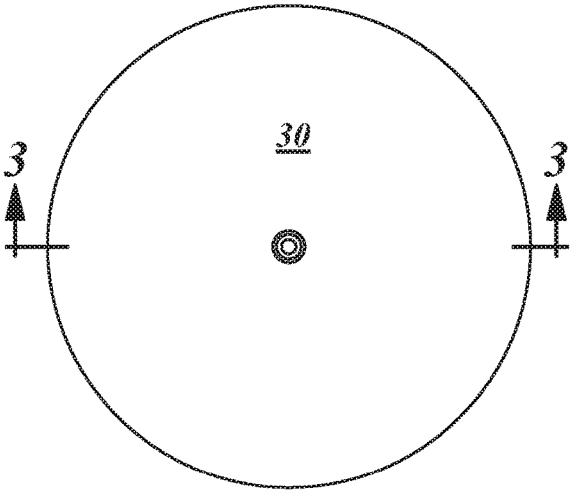
FIG. 2 is a top plan view of the apparatus illustrated in FIG. 1 for sealing a foil liner to the container.
Figure 4:
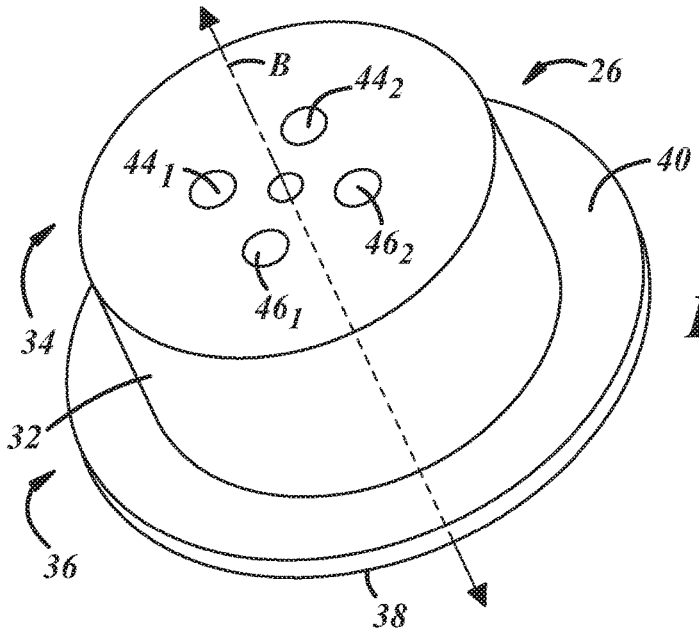
FIG. 4 is a perspective view of one illustrative embodiment of a seal head of the apparatus illustrated in FIGS. 1 and 3.

As illustrated in FIGS. 3 and 4, in an embodiment, the seal head 26 of the apparatus 12 includes a body 32 having a first end 34, a second end 36 axially opposite the first end 34, and a longitudinal axis B extending through the first end 34 and second end 36 of the body 32 that, when the apparatus 12 is engaged with the container 10 as illustrated in FIGS. 1 and 2, is coincident with the axis A of the container 10. The body 32 includes further an axially-facing sealing surface 38 at the second end 36 thereof that faces away from the first end 34. In an illustrative embodiment, the body 32 may comprise further an annular or radially-outwardly extending flange 40 at the second end 36, the flange 40 including the axially-facing sealing surface 38. It will be appreciated, however, that in other embodiments, the body 32 may not include such a flange. In any event, the body 32 may take on a number of geometric shapes. In the illustrated embodiment, the body 32 generally has a cylindrical shape (i.e., a circular cross-section); however, in other embodiments, the body 32 may have a shape other than a cylindrical shape or circular cross-section (e.g., a square or rectangular cross-section), or different portions of the body 32 may have different shapes or cross-sections (i.e., different cross-sectional shapes or the same cross-sectional shape with different cross-sectional sizes). Accordingly, the present disclosure is not limited to the body 32 having any particular shape(s).

With reference to FIG. 3, in an embodiment, the seal head 26 includes further a recess 42 in the seal head body 32. The recess 42 is disposed radially inward and axially inboard of the axially-facing sealing surface 38 of the body 32, and in an embodiment wherein the seal head body 32 includes the flange 40, the recess 42 may also be disposed radially-inward of the flange 40. In any case, the recess 42 is configured such that when the apparatus 12 is engaged with the container 10, the recess 42 overlies at least a portion of the mouth 22 of the container 10 and the foil liner 14 that is being secured and sealed to the sealing surface (or lip) 24 of the container 10. As will be described in greater detail below, the recess 42 comprises one segment of one or more fluid paths formed in the seal head 26.

With continued reference to FIG. 3, in addition to the body 32 and the recess 42, the seal head 26 may include further an inlet passageway 44 and an outlet passageway 46, both of which extend through the seal head body 32 and are in fluid communication with the recess 42 and each other. In the embodiment illustrated in FIGS. 3 and 4, both of the inlet and outlet passageways 44, 46 extend from the first end 34 of the seal head body 32 through the second end 36 thereof. However, in other embodiments, rather than extending from the first end 34 of the seal head body 32, one or both of the inlet and outlet passageways 44, 46 may extend from a point of the seal head body 32 located between the first and second ends 34, 36 of the seal head body 32 (e.g., in a sidewall of the seal head body 32) through the second end 36. Accordingly, the present disclosure is not limited to any particular arrangement of the inlet and outlet passageways 44, 46.

In any event, and as illustrated in FIG. 3, the inlet passageway 44, the outlet passageway 46, and the recess 42 combine to form or define one or more fluid paths 48 in and through the seal head 26 for passing a fluid through and out of the seal head and onto at least a portion of the foil liner being sealed to a container. More particularly, when the apparatus 12 is engaged with the sealing surface 24 of the container 10 such that the recess 42 of the seal head 26 overlies the foil liner 14 over the mouth 22 portion of the container 10 and a seal is formed between the apparatus 12 and the foil liner 14, a fluid may be introduced into the fluid path 48 by a fluid source (not shown) and may then be passed through the fluid path 48 and onto the foil liner 14 to, as will be described below, cool the foil liner 14 and/or the head space of the container 10 disposed proximate to the foil liner 14 (e.g., below or beneath the foil liner 14), and/or to create pressure within the recess 42 proximate the foil liner 14 (also referred to herein as "over-pressure") that is applied to the foil liner 14. In other words, fluid is introduced into and forced or passed through the inlet passageway 44, through the recess 42 (and thus out of the seal head 26) and onto at least a portion of the foil liner 14 that extends over the mouth 22 of the container 10, and then through the outlet passageway 46 where it is expelled from the seal head 26. In an embodiment, the fluid passed through the fluid path 48 may be pressurized and/or cooled air (e.g., compressed air) or other gas, which may be blown into the fluid path 48 by a suitable source S (e.g., a vortex tube chiller, gas cylinder, etc.).

It will be appreciated that while the description above has been with respect to an embodiment wherein the seal head 26 comprises one inlet passageway 44 and one outlet passageway 46, in other embodiments the seal head 26 may comprise a plurality of inlet passageways 44 and/or outlet passageways 46 such that the seal head 26 may include a plurality of fluid paths 48. For example, in the embodiment illustrated in FIG. 4, the seal head 26 includes a first inlet passageway $\mathbf{44}_1$ and a second inlet passageway 442, and a first outlet passageway $\mathbf{46}_1$ and a second outlet passageway $\mathbf{46}_2$. In such an embodiment, each of the inlet passageways $\mathbf{44}_1$, $\mathbf{44}_2$ extend through the seal head body 32 and are in fluid communication with the recess 42 and the outlet passageways $\mathbf{46}_1$, $\mathbf{46}_2$, which also extend through the seal head body 32 and are in fluid communication with the recess 42 and the inlet passageways $\mathbf{44}_1$, $\mathbf{44}_2$. Moreover, while the description above has been with respect to embodiments wherein the seal head 26 has an equal number of inlet and outlet passageways, in other embodiments the seal head 26 may have an unequal number of such passageways (e.g., more inlet passageways than outlet passageways, or vice versa). Accordingly, the present disclosure is not limited to the seal head 26 having any particular number(s) of inlet passageways, outlet passageways, or fluid paths.

With reference to FIG. 3, and as briefly described above, the apparatus 12 further comprises the facing 28. In an illustrative embodiment, the facing 28 may be composed of an elastomeric material (e.g., rubber); however, the present disclosure is not meant to be so limited as facings composed of materials other than an elastomeric material may also be suitable. In an embodiment, when the facing 28 is assembled with the seal head 26, the facing 28 is carried by the body 32 of the seal head 26 at the second end 36 thereof. In the embodiment illustrated in FIG. 3, the facing 28 is disposed adjacent to, and is in contact with, the axially-facing sealing surface 38 of the seal head body 32, and extends radially across and axially into the recess 42 of the seal head 26. Accordingly, the facing 28 has a peripheral edge 50 and a central portion 52 disposed radially-inward of the peripheral edge 50. In addition, the facing 28 further includes a plurality of spaced-apart apertures 54 that are located both radially-inward of the peripheral edge 50 of the facing 28 and radially-outward of the central portion 52 of the facing 28. When the facing 28 is assembled with the seal head 26, the apertures 54 correspond to the inlet and outlet passageways 44, 46. In an embodiment, each of the apertures 54 is aligned with a respective one of the inlet and outlet passageways 44, 46. For example, in the embodiment illustrated in FIG. 3, a first aperture $\mathbf{54}_1$ of the facing 28 is aligned with the inlet passageway 44 and a second aperture $\mathbf{54}_2$ is aligned with the outlet passageway 46. The apertures 54 allow for the flow of fluid (e.g., air) from the inlet passageway 44 into the recess 42, and from the recess 42 into the outlet passageway 46.

While the description above has been with respect to an embodiment wherein the facing 28 has a pair of apertures 54 (i.e., $\mathbf{54}_1$, $\mathbf{54}_2$), it will be appreciated that in other embodiments the facing 28 may include more than two apertures 54. More particularly, the number of apertures 54 in the facing 28 will generally be equal to the combined number of inlet and outlet passageways 44, 46. For instance, in an embodiment wherein the seal head 26 includes two (2) inlet passageways 44 and two (2) outlet passageways 46, the facing 28 may include four (4) apertures 54—one for each of the two (2) inlet passageways 44, and one for each of the two (2) outlet passageways 46. Similarly, if the seal head 26 includes two (2) inlet passageways 44 and one (1) outlet passageway 46, the facing 28 may include three (3) apertures 54—one for each of the two (2) inlet passageways 44, and one for the outlet passageway 46. Accordingly, the present disclosure is not limited to the facing 28 including any particular number of apertures 54.

As described above, when assembled with the seal head 26, the facing 28 is carried by the body 32 of the seal head 26 at the second end 36 thereof. The facing 28 may be coupled to the seal head body 32 in a number of ways. For example, the facing 28 may be coupled to the seal head body 32 at the central portion 52 of the facing 28. In the embodiment illustrated in FIG. 3, the central portion 52 of the facing 28 is affixed to the seal head body 32 by one or more mechanical fasteners, for example, a screw (or screw and washer). More particularly, the facing 28 may have an aperture 56 in the central portion 52 thereof that may be aligned with a threaded hole or bore 58 in the seal head body 32 located within the recess 42 of the seal head 26 (e.g., at the center portion of the recess 42 and extending axially along the longitudinal axis B of the seal head body 32). A screw 60 may be inserted through the aperture 56 in the facing 28 and the threaded hole 58 in the seal head body 32 to affix the facing 28 to the seal head body 32. The screw 60 may allow for the tension of the facing 28 to be adjusted.

Additionally, or in the alternative, the facing 28 may be coupled to the seal head body 32 at the peripheral edge 50 thereof. For example, the peripheral edge 50 of the facing 28 may overlie at least a portion of the axially-facing sealing surface 38 of the seal head body 32 and may be coupled thereto. In the embodiment illustrated in FIG. 3, the peripheral edge 50 of the facing is affixed to the axially-facing seal surface 38 by one or more mechanical fasteners, for example, one or more screws (or one or more screws and washers). More particularly, the facing 28 may have a plurality of apertures 62 in the peripheral edge 50 thereof, each of which may be aligned with a corresponding threaded hole or bore 64 in the axially-facing sealing surface 38 of the seal head body 32 (e.g., axially extending into the seal head body 32). A screw 66 may then be inserted through the aperture 62 of the facing 28 and the threaded hole 64 in the sealing surface 38 to affix the facing 28 to the seal head body 32.

Figure 5:
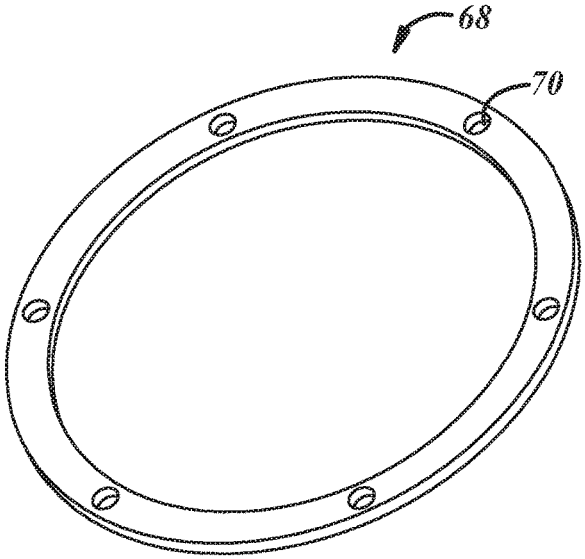
FIG. 5 is a perspective view of one illustrative embodiment of a mounting ring for affixing a facing of the apparatus illustrated in FIGS. 1, 3, and 4 to a sealing surface of the seal head illustrated in FIG. 4.
Figure 6:
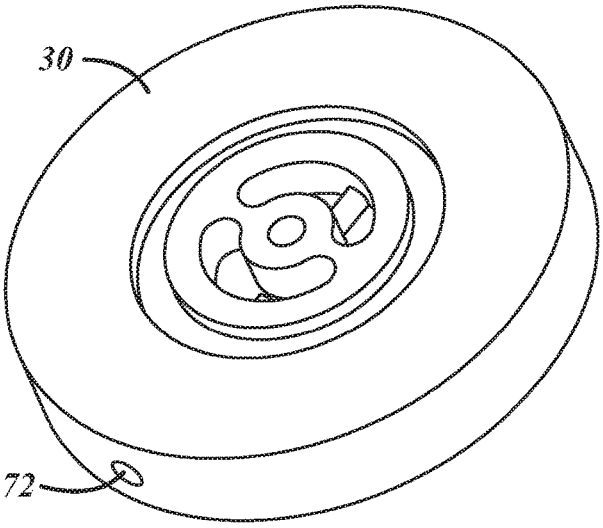
FIG. 6 is a perspective view of one illustrative embodiment of an insulating disc of the apparatus illustrated in FIGS. 1 and 3.

In an illustrative embodiment, and with reference to FIGS. 3 and 5, a mounting ring 68 may also be used to affix the facing 28 to the sealing surface 38. More particularly, the mounting ring 68 is placed over the facing 28 such that the peripheral edge 50 of the facing 28 is disposed between the sealing surface 38 and the mounting ring 68. The mounting ring 68 may have a plurality of apertures 70 therein, each of which may be aligned with a corresponding aperture 62 of the facing 28 and a threaded hole or bore 64 in the sealing surface 38 of the seal head body 32. A screw 66 may then be inserted through the aperture 70 of the mounting ring 68, the aperture 62 of the facing 28, and the threaded hole 64 in the sealing surface 38 to affix the facing 28 to the seal head body 32.

While the description above has been primarily with respect to the affixing or coupling of the facing 28 to the seal head body 32 using mechanical fasteners, it will be appreciated that the facing 28 may be coupled to the seal head body 32 in any number of additional or alternative ways (e.g., by adhesives and/or different types of mechanical fasteners than those described above). Thus, the present disclosure is not intended to be limited to any particular techniques for coupling the facing 28 to the seal head body 32.

With reference to FIGS. 1-3 and 6, in an embodiment, the apparatus 12 further includes the insulating disc 30. Referring to FIG. 3, when assembled with the seal head 26, the insulating disc 30 is carried by the body 32 of the seal head 26 at the first end 34 thereof and is disposed between the fluid source that introduces fluid into the inlet passageway 44 of the seal head 26 and the seal head 26 itself (e.g., the insulating disc 30 is located downstream of the fluid source and upstream of seal head 26. The insulating disc 30 includes a first or inlet channel 72 and a second or outlet channel 74 extending therethrough that, when the insulating disc 30 is assembled or coupled with the seal head body 32, correspond to the inlet and outlet passageways 44, 46 in the seal head body 32 (e.g., the inlet channel 72 is in fluid communication with the inlet passageway 44, and the outlet passageway 46 is in fluid communication with the outlet channel 74). In an illustrative embodiment, each of the inlet and outlet channels 72, 74 is aligned and in fluid communication with a respective one of the inlet and outlet passageways 44, 46 in the seal head body 32. In any event, in an embodiment wherein the apparatus 12 includes the insulating disc 30, fluid (e.g., air) is introduced (e.g., blown) into the inlet channel 72 of the insulating disc 30 and passes through the fluid path 48 of the seal head 26 before flowing out of the seal head 26 and through the outlet channel 74 of the insulating disc 30, where the fluid flows out of the insulating disc 30.

It will be appreciated that while the description above has been with respect to an embodiment wherein the insulating disc 30 comprises only one inlet channel 72 and one outlet channel 74, in other embodiments the insulating disc 30 may comprise a plurality of inlet channels 72 and/or outlet channels 74. For example, in an embodiment wherein the seal head 26 comprises a pair of inlet passageways 44, the insulating disc 30 may comprise a pair of inlet channels 72—each inlet channel 72 corresponding to and being in fluid communication with a respective one of the inlet passageways 44. Similarly, in an embodiment wherein the seal head 26 comprises a pair of outlet passageways 46, the insulating disc 30 may comprise a pair of outlet channels 74—each outlet channel 74 corresponding to and being in fluid communication with a respective one of the outlet passageways 46. Moreover, while the description above has been with respect to embodiments wherein the number of inlet channels 72 and outlet channels 74 of the insulating disc 30 is equal to the number of inlet passageways 44 and outlet passageways 46 of the seal head 26, in other embodiments, the number of inlet channels 72 may be greater than the number of inlet passageways 44, and/or the number of outlet channels 74 may be greater than or less than the number of outlet passageways 46. For example, in an embodiment, the insulating disc 30 may include a single inlet channel 72, while the seal head 26 may include a plurality of inlet passageways 44. In such an embodiment, the inlet channel 72 may be in fluid communication with each of the plurality of inlet passageways 44. Conversely, in another embodiment, the insulating disc 30 may include a plurality of inlet channels 72, while the seal head 26 may include a single inlet passageway 44. In such an embodiment, each of the inlet channels 72 may be in fluid communication with the inlet passageway 44. Similarly, in an embodiment, the insulating disc 30 may include a single outlet channel 74, while the seal head 26 may include a plurality of outlet passageways 46. In such an embodiment, the outlet channel 72 may be in fluid communication with each of the plurality of outlet passageways 46. Conversely, in another embodiment, the insulating disc 30 may include a plurality of outlet channels 74, while the seal head 26 may include a single outlet passageway 46. In such an embodiment, each of the outlet channels 74 may be in fluid communication with the outlet passageway 46. Accordingly, the present disclosure is not limited to the insulating disc 30 having any particular number(s) of inlet and/or outlet channels.

In any case, the insulating disc 30 may be coupled to the seal head 26, and the body 32 thereof, in particular, in a number of ways, including, for example, by use of screws or other types of mechanical fasteners.

In addition to the components of the apparatus 12 described above, in an embodiment, the apparatus 12 may include further one or more regulators disposed within the fluid flow between the fluid source and the seal head 26, and/or within the fluid flow between the seal head 26 and atmosphere or a downstream component of the apparatus 12. More particularly, in an embodiment, a regulator R may be used before or upstream of the inlet channel 72 of the insulating disc 30 and/or after or downstream of the outlet channel 74 of the insulating disc 30. The regulator(s) R may be used to vary the flow of the fluid through the seal head 26, which may, for example and as described below, allow for pressure created on the foil liner 14 during sealing to be adjusted (i.e., increased or decreased) to eliminate or at least minimize the deformation or tearing of, or forming of wrinkles in, the foil liner 14.

Figure 7:
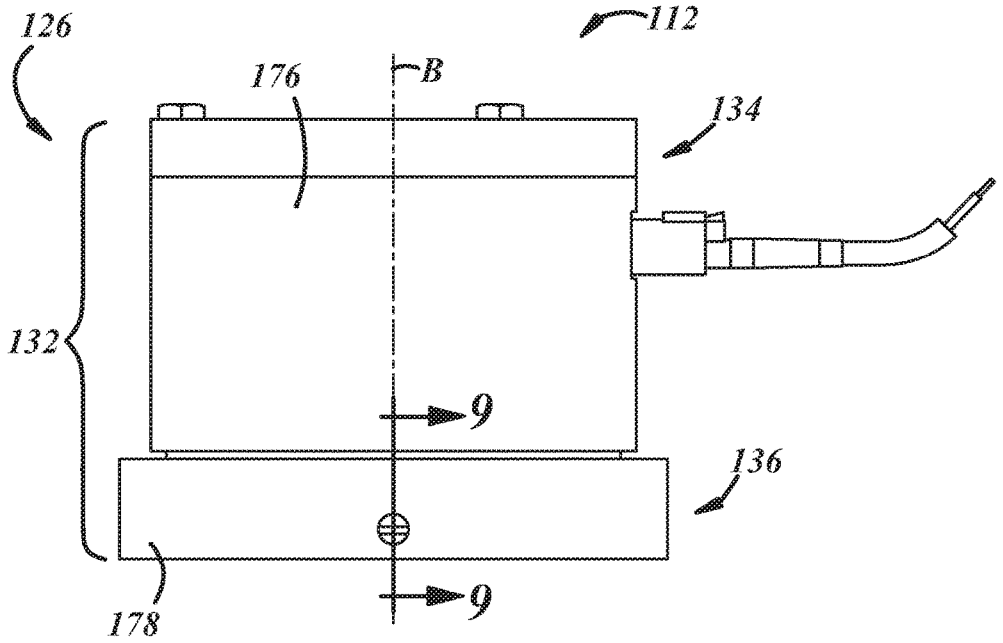
FIG. 7 is an elevational view of apparatus for sealing a foil liner to a container in accordance with another illustrative embodiment of the present disclosure.
Figure 8:
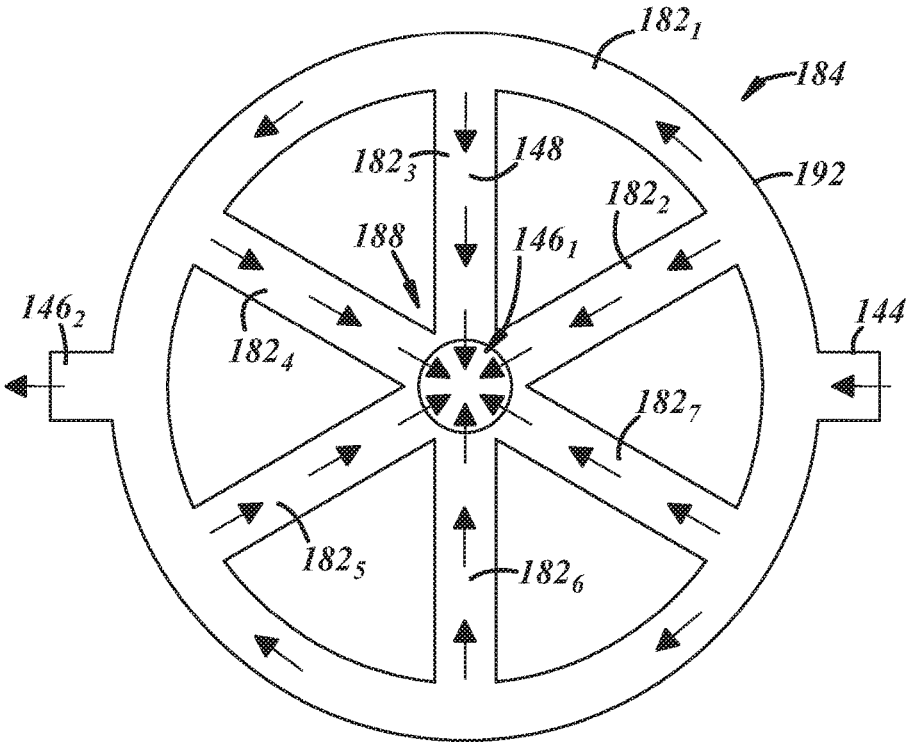
FIG. 8 is a plan view of an illustrative embodiment of a plate of the apparatus illustrated in FIG. 7 having a plurality of fluid pathways disposed therein.
Figure 9:
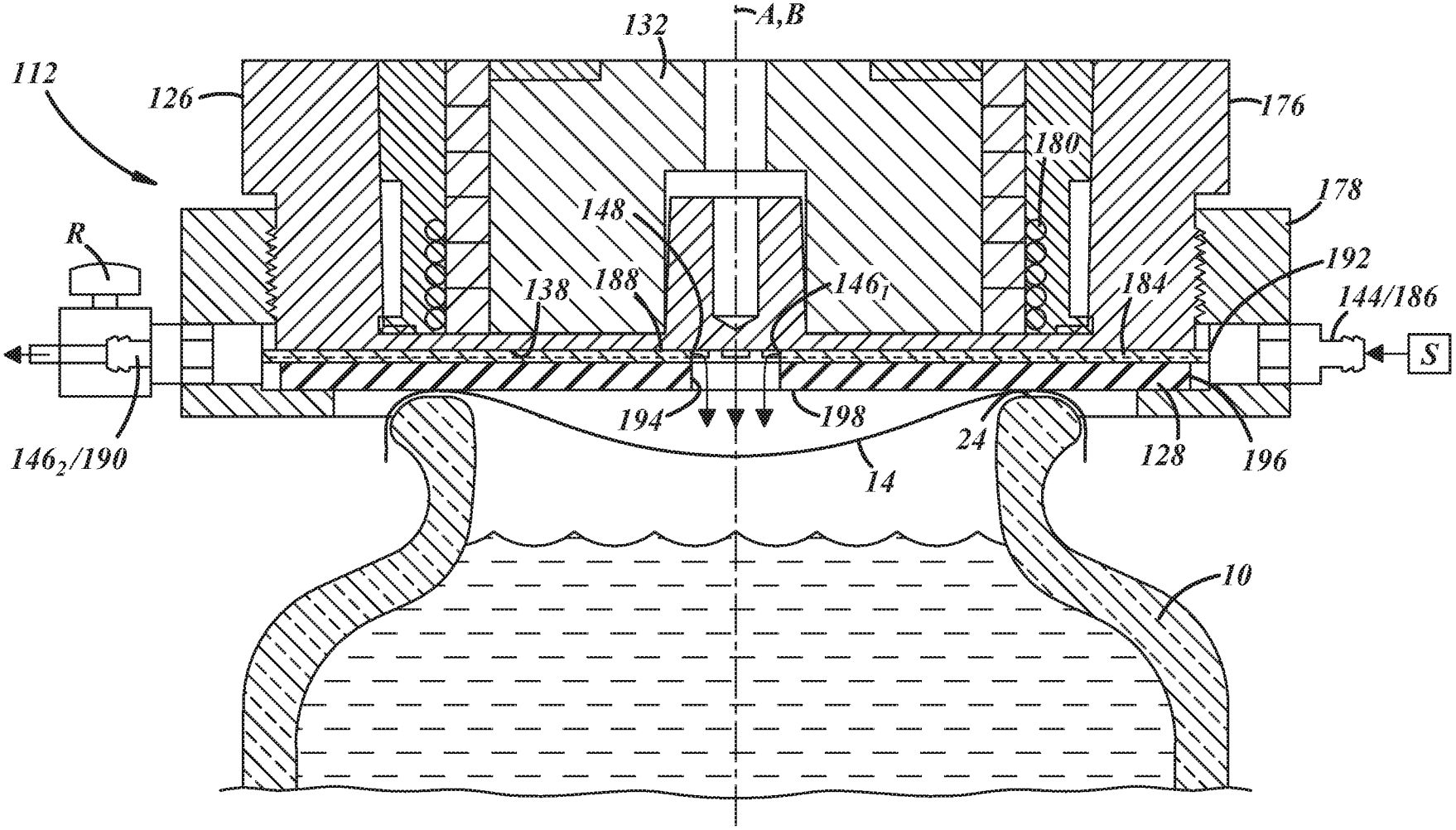
FIG. 9 is a fragmentary sectional view of one illustrative embodiment of the apparatus illustrated in FIG. 7 taken along line 9-9 of FIG. 7.

As briefly described above, the embodiment of apparatus 12 shown in FIGS. 1-6 comprises an apparatus for conduction sealing a foil liner to a sealing surface of a container. It will be appreciated, however, that in other embodiments, the apparatus 12 may take a different form from that described above and illustrated in FIGS. 1-6. For example, FIGS. 7-9 illustrate an embodiment wherein the apparatus 12 (i.e., apparatus 112) comprises an apparatus for induction sealing a foil liner to a sealing surface of a container. The apparatus 112 may include, for example, a seal head 126 and, in at least some embodiments, a facing or overlay 128, to cite a few possibilities.

As illustrated in FIGS. 7 and 9, in an embodiment, the seal head 126 of the apparatus 112 includes a body 132 having a first end 134, a second end 136 axially opposite the first end 134, and a longitudinal axis B extending through the first end 134 and second end 136 of the body 132 that, when the apparatus 112 is engaged with the container 10, as illustrated in FIG. 9, is coincident with the axis A of the container 10. The body 132 includes further an axially-facing sealing surface 138 at the second end 136 thereof that faces away from the first end 134. In one embodiment, the body 132 is of a unitary construction; in other embodiments, however, the body 132 may be constructed of a number of pieces that combine to form the body 132. For example, in the illustrative embodiment shown in FIG. 9, the body 132 is comprised of a first piece 176 and a second piece 178 that is configured to be coupled with the first piece 176 using any number of techniques known in the art, for example, mechanical fasteners, an interference fit, etc. In the embodiment illustrated in FIG. 9, the first and second pieces 176, 178 are configured to be coupled together by the mating of complementary threads disposed on each piece. In other words, the second piece 178 may be threaded onto the first piece 176, or vice versa. Accordingly, it will be appreciated that the present disclosure is not intended to be limited to any particular coupling arrangement(s) or technique(s) for coupling different pieces of the body 132 together, but rather any suitable arrangement or technique may be used.

With continued reference to FIG. 9, the seal head 126 includes further one or more induction coils 180 disposed within the body 132 thereof. Each induction coil 180 may comprise any suitable induction coil known in the art that is configured to generate or produce an electromagnetic field suitable for use in sealing a foil liner to a sealing surface of a container. In an embodiment, the coil(s) 180 may be sized such that when the seal head 126 is aligned and/or engaged with the container 10, the conductors of the coil are substantially aligned with the sealing surface 24 of the container 10. In general terms, and as is well known in the art, when the coil(s) 180 is energized, an electromagnetic field is generated proximate the coil 180. This field excites particles in the foil liner 14 being sealed to the sealing surface 24 of the container 10 resulting in the heating of the foil liner 14. As the foil liner 14 heats, a polymer layer thereof melts and binds to the sealing surface 24 of the container 10 to seal the foil liner 14 to the container 10.

In addition to the components described above, the seal head 126 may include further an inlet passageway 144, one or more outlet passageways 146, and one or more fluid pathways 182 in fluid communication with the inlet passageway 144 and outlet passageway(s) 146. More particularly, the inlet passageway 144, outlet passageway(s) 146, and fluid pathway(s) 182 are in fluid communication with each other and define one or more fluid paths 148 for passing fluid through and out of the seal head 126 and onto the foil liner 14 being sealed to the sealing surface 24 of the container 10 when the apparatus 112 (i.e., the seal head 126 thereof, in particular) is engaged with the container 10. As shown in FIG. 9, the fluid path(s) 148, or at least one or more portions or segments thereof, is/are disposed below the induction coil(s) 180.

The inlet passageway 144 may be disposed in the body 132 of the seal head 126 and/or in a separate component of the seal head 126. In an illustrative embodiment, the inlet passageway 144 is disposed within a plate 184 like that shown in FIG. 8, which, as shown in FIG. 9, may be carried by the seal head body 132 and may be disposed adjacent to the axially-facing sealing surface 138 thereof. In the embodiment illustrated in FIG. 8, the plate 184 has an open face, and thus, the inlet passageway 144 comprises an open groove in the plate 184 that is closed by the sealing surface 138 of the seal head body 132 when the plate 184 is coupled with the seal head body 132 as described below. In other embodiments, however, where the plate 184 does not have an open face, the inlet passageway 144 may comprise an enclosed channel (i.e., the entire perimeter of the channel is defined by the plate 184) disposed in the plate 184. In an embodiment, the inlet passageway 144 may further include or be in fluid communication with a fitting 186 for coupling the seal head 126, and the fluid inlet 144 thereof, in particular, to a fluid source S. The inlet passageway 144 is configured to allow fluid from the fluid source S to pass into the fluid pathway(s) 182 in the seal head 126. It will be appreciated that while the description above has been with respect to an embodiment wherein the seal head 126 comprises one inlet passageway 144, in other embodiments the seal head 126 may comprise a plurality of inlet passageways 144. Accordingly, the present disclosure is not limited to the seal head 126 having any particular number(s) of inlet passageways. Additionally, while the description above has been with respect to an embodiment wherein the inlet passageway 144 is disposed within the plate 184 of the seal head, it will be appreciated that other arrangements are certainly possible (e.g., the fitting 186 of the seal head may comprise the inlet passageway 144, the inlet passageway 144 may be disposed within the body 132 of the seal head 126, etc.). Accordingly, the present disclosure is not limited to any particular arrangement(s) for the inlet passageway 144.

As with the inlet passageway 144, the fluid pathway(s) 182 may be disposed in the body 132 of the seal head 126 and/or a separate component of the seal head 126, and is/are configured to pass fluid from the inlet passageway 144 to the outlet passageway(s) 146. With reference to FIGS. 8 and 9, in an illustrative embodiment, the seal head 126 includes a plurality of fluid pathways 182 (e.g., pathways $\mathbf{182}_1$-$\mathbf{182}_7$) disposed within the plate 184 of the seal head 126, one or more, and in some embodiments, all, of which is/are in fluid communication with the inlet passageway 144 and one or more of the outlet passageway(s) 146. The fluid pathway(s) 182 may be arranged in a number of ways. For example, in the embodiment illustrated in FIG. 8, the fluid pathway $\mathbf{182}_1$ extends about the perimeter of the plate 184, while each of the other pathways $\mathbf{182}_2$-$\mathbf{182}_7$ extend radially inward from the fluid pathway $\mathbf{182}_1$ to an outlet passageway $\mathbf{146}_1$ disposed in the center of the plate 184. Other arrangements, however, are certainly possible, and thus, the present disclosure is not intended to be limited to any particular arrangement(s) of fluid pathway(s) 182. In the embodiment illustrated in FIG. 8, the plate 184 has an open face, and thus, the fluid pathways 182 disposed therein comprise open grooves in the plate 184 that are closed by the sealing surface 138 of the seal head body 132 when the plate 184 is coupled with the seal head body 132. In other embodiments, however, one or more of the fluid pathways 182 may comprise enclosed channels (i.e., the entire perimeter of a channel is defined by the plate 184) disposed in the plate 184. It will be appreciated that while the description above has been with respect to an embodiment wherein the seal head 126 comprises a plurality of fluid pathways 182, in other embodiments, the seal head 126 may comprise a single fluid pathway 182, or more than the number of pathways shown in FIG. 8. Accordingly, the present disclosure is not limited to the seal head 126 having any particular number(s) of fluid pathways 182. Additionally, while the description above has been with respect to an embodiment wherein the fluid pathways 182 are disposed within the plate 184 of the seal head 126, it will be appreciated that other arrangements are certainly possible (e.g., the fluid pathways(s) 182 may be disposed within the body 132 of the seal head 126, etc.). Accordingly, the present disclosure is not limited to any particular arrangement(s) for the fluid pathway(s) 182.

Similar to the inlet passageway 144 and the fluid pathway(s) 182, the outlet passageway(s) 146 of the seal head 126 may be disposed in the body 132 of the seal head 126 and/or a separate component of the seal head 126. In an illustrative embodiment, the seal head 126 has a plurality of outlet passageways 146, each of which is disposed within the plate 184 of the seal head 126 and in fluid communication with the inlet passageway 144 and at least one fluid pathway 182. In an embodiment, at least one of the outlet passageways 146 (e.g., outlet passageway $\mathbf{146}_1$ in FIGS. 8 and 9) is arranged such that when the seal head 126 is engaged with the container 10 as shown in FIG. 9, the passageway $\mathbf{146}_1$ extends (at least partially) axially through the plate 184 such that fluid flowing therethrough is passed or directed onto the foil liner 14, and through which fluid passed onto the foil liner 14 may be passed back to a fluid pathway 182 and ultimately expelled from the seal head 126. Because the axially-extending passageway $\mathbf{146}_1$ is configured or intended to allow fluid to pass onto the foil liner 14, the passageway $\mathbf{146}_1$ may be disposed radially inward of an outer periphery of the seal head body 132 and/or an outer periphery 192 of plate 184. In an illustrative embodiment, the plate 184 has a central portion 188, and the outlet passageway $\mathbf{146}_1$ is disposed in the central portion 188 of the plate 184. It will be appreciated that while the description above has been primarily with respect to an embodiment having one axially-extending passageway (passageway $\mathbf{146}_1$), other embodiments may include a plurality of such axially-extending outlet passageways, and thus, the present disclosure is not limited to any particular number of axially-extending outlet passageways. In any event, in an embodiment such as that illustrated in FIGS. 8 and 9, at least one of the outlet passageways 146 (e.g., outlet passageway $\mathbf{146}_2$ in FIGS. 8 and 9) may be arranged such that fluid passing therethrough flows out of the seal head 126 to either atmosphere or another component of the apparatus 112. In such an embodiment, the outlet passageway $\mathbf{146}_2$ may include or be in fluid communication with a fitting 190 to allow the fluid to flow from the seal head 126 to atmosphere or another component of the apparatus 112. It will be appreciated that while the description above has been primarily with respect to an embodiment having one outlet passageway (passageway $\mathbf{146}_2$) for passing fluid out of the seal head 126, in other embodiments, the seal head 126 may include a plurality of such outlet passageways, and thus, the present disclosure is not limited to any particular number of outlet passageways for passing fluid out of the seal head 126. Additionally, while the description above has been with respect to an embodiment wherein the outlet passageway(s) 146 are disposed within the plate 184 of the seal head, it will be appreciated that other arrangements are certainly possible (e.g., the fitting 190 of the seal head may comprise an outlet passageway 146 (i.e., outlet passageway $\mathbf{146}_2$), one or more outlet passageways 146 may be disposed within the body 132 of the seal head 126 rather than within the plate 184, etc.). Accordingly, the present disclosure is not limited to any particular arrangement(s) for the outlet passageway(s) 146.

As briefly described above, in an embodiment wherein the seal head 126 includes the plate 184 shown in FIG. 8, the plate may be coupled to the seal head body 132 in a number of ways. For example, the plate 184 may be coupled to the seal head body 132 at the peripheral edge 192 thereof. More particularly, the peripheral edge 192 may be aligned with a portion of either one or both of the first and second pieces 176, 178 of the seal head body 132 and then captured therebetween when the first and second pieces 176, 178 are coupled together. It will be appreciated, however, that other coupling arrangements are certainly possible, for example, mechanical fasteners and adhesives, to cite two possibilities. Accordingly, it will be appreciated that the present disclosure is not intended to be limited to any particular technique(s) or arrangement(s) for coupling the plate 184 to the seal head body 132.

In any event, and with reference to FIG. 9, the inlet passageway 144, outlet passageway(s) 146, and fluid pathway(s) 182 combine to form or define one or more fluid paths 148 in the seal head 126 for passing fluid through and out of the seal head 126 and onto the at least a portion of the foil liner being sealed to a container. More particularly, when the apparatus 112 is engaged with the sealing surface 24 of the container 10 such that at least one outlet passageway 146 overlies the foil liner 14 over the mouth 22 of the container 10, a fluid may be introduced into the fluid path(s) 148 by a fluid source S and may then be passed therethrough and onto the foil liner 14 to cool the foil liner 14 and/or the head space of the container 10 disposed proximate the foil liner 14, and/or to apply an over-pressure onto the foil liner 14. In other words, fluid is introduced into and forced or passed through the inlet passageway 144, through the fluid pathway(s) 182, and through the outlet passageway(s) 146 (passageway $\mathbf{146}_1$) and thus out of the seal head 126 and onto the foil liner 14. In certain instances, the fluid may then pass back through the outlet passageway 146 (passageway $\mathbf{146}_1$), through fluid pathway(s) 182, and through another outlet passageway 146 (passageway $\mathbf{146}_2$) where it is expelled from the seal head 126. As with the embodiment of seal head 26 described above, the fluid passed through the fluid path(s) 148 may comprise any number of suitable fluids, for example, pressurized and/or cooled air (e.g., compressed air) or other gas, which may be blown into the fluid path(s) 148 by an suitable source S (e.g., a vortex tube chiller, gas cylinder, etc.).

In addition to the seal head 126 described above, in at least some embodiments, the apparatus 112 may include further the facing 128. In an illustrative embodiment, the facing 128 may be composed of an elastomeric material (e.g., rubber); however, the present disclosure is not meant to be so limited as facings composed of other materials may certainly be suitable for use. In an embodiment, when the facing 128 is assembled with the seal head 126, the facing 128 is carried by the seal head body 132 at the second end 136 thereof. In the embodiment illustrated in FIG. 9, the facing 128 is disposed adjacent to, and is in contact with, the plate 184; though in other embodiments, the facing may be disposed adjacent to and in contact with the axially-facing sealing surface 138 of the seal head body 132 instead. In any event, in an embodiment, the facing 128 extends radially across the seal head 126. In addition the facing 128 may further include one or more apertures 194 located radially inward of a peripheral edge 196 of the facing 128. In an embodiment, for example that illustrated in FIG. 9, the facing 128 includes a central portion 198 and one or more apertures 194 may be disposed in the central portion 198. When the facing 128 is assembled with the seal head 126, the aperture(s) 194 is/are intended to provide a flow path from one or more of the outlet passageways 146 of the seal head 126 to the foil liner 14. For example, in the embodiment illustrated in FIG. 9, the facing 128 includes a single aperture 194 that is aligned and in fluid communication with the outlet passageway $\mathbf{146}_1$ of the seal head 126. Accordingly, in an embodiment wherein the seal head 126 comprises a plate 184 in which one or more outlet passageways 146 for passing fluid onto the foil liner are disposed therein, one or more aperture(s) 194 in the facing 128 are aligned with one or more of the outlet passageways 146 to allow fluid to pass from the seal head 126 and onto the foil liner 14 (e.g., in FIG. 9, the aperture 194 is aligned with the outlet passageway $\mathbf{146}_1$ to allow fluid to pass onto the foil liner 14. While the description above has been primarily with respect to an embodiment wherein the facing 128 includes a single aperture 194, it will be appreciated that in other embodiments, the facing 128 may include more than one aperture.

More particularly, the number of apertures will generally be equal to the number of outlet passageways 146 that provide a flow path for fluid to pass from the seal head 126 and onto the foil liner 14. Accordingly, the present disclosure is not intended to be limited to the facing 128 including any particular number of apertures 194.

When assembled with the seal head 126, the facing 128 is carried by the body 132 of the seal head 126 at the second end 136 thereof. The facing 128 may be coupled to the seal head body 132 in any number of ways. For example, and like the plate 184 described above, the facing 128 may be coupled to the seal head body 132 at the peripheral edge 196 thereof. More particularly, the peripheral edge 196 may be aligned with a portion of either one or both of the first and second pieces 176, 178 of the seal head body 132 and then captured therebetween when the first and second pieces 176, 178 are coupled together. It will be appreciated, however, that other coupling arrangements are certainly possible, for example, mechanical fasteners and adhesives, to cite two possibilities. Accordingly, it will be appreciated that the present disclosure is not intended to be limited to any particular technique(s) or arrangement(s) for coupling the facing 128 to the seal head body 132.

In addition to the components described above, the apparatus 112 may include further one or more regulators disposed within the fluid flow between the fluid source S and the seal head 126, and/or within the fluid flow between the seal head 126 and atmosphere or a downstream component of the apparatus 112. More particularly, in an embodiment, a regulator R may be used before or upstream of the inlet passageway 144 of the seal head 126 and/or, as shown in FIG. 9, after or downstream of one or more of the outlet passageways 146 of the seal head 126. The regulator(s) R may be used to vary the flow of the fluid through the seal head 126, which may, for example and as described below, allow for pressure created on the foil liner 14 during sealing (e.g., an over-pressure applied to the foil by the seal head 126) to be adjusted (i.e., increased or decreased) to eliminate or at least minimize the deformation or tearing of, or forming of wrinkles in, the foil liner 14.

Figure 10:
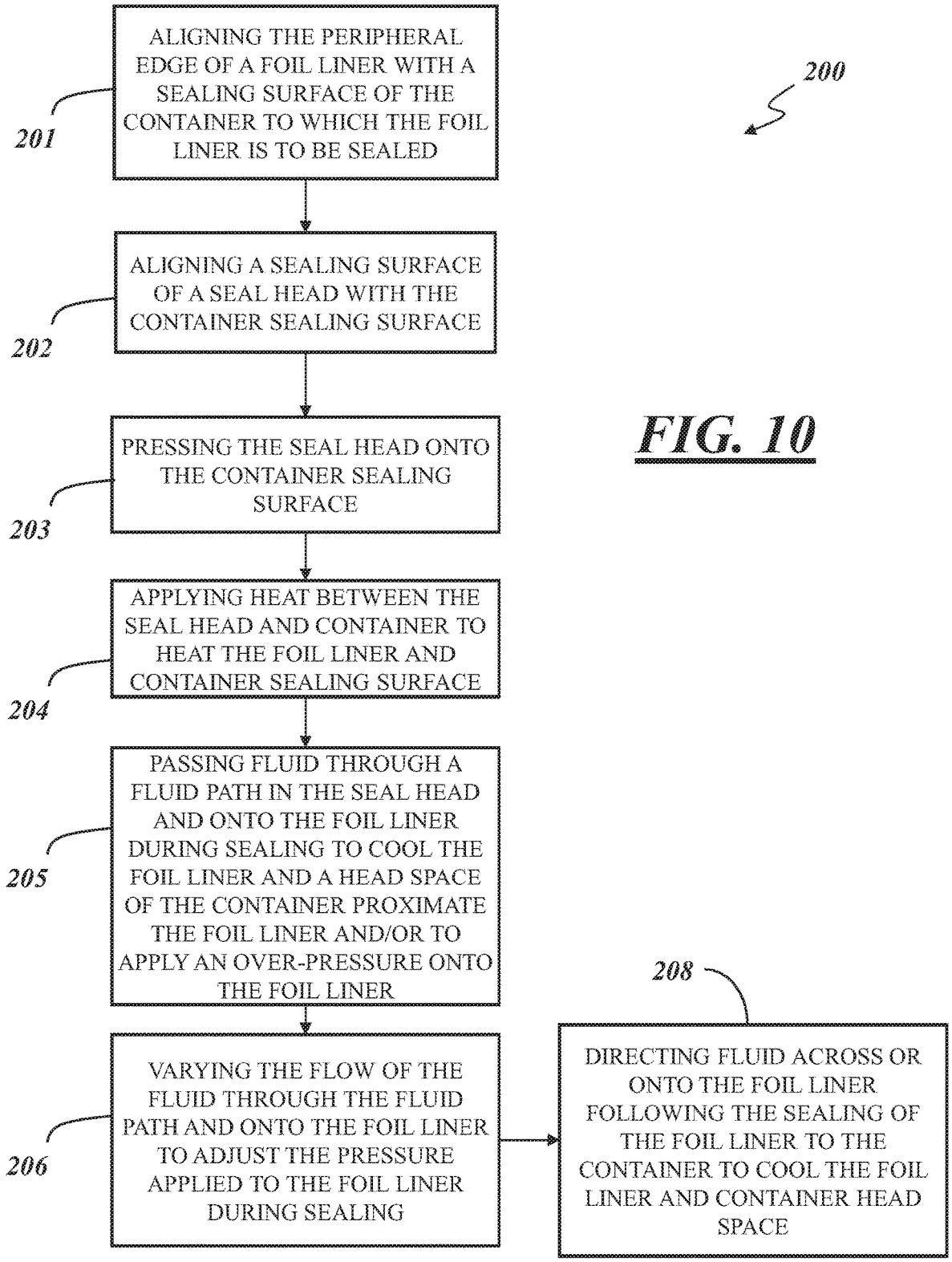
FIG. 10 is a flow chart of a method of sealing a foil liner to a sealing surface of a container in accordance with an illustrative embodiment of the present disclosure.

Turning now to FIG. 10, there is shown a method 200 of sealing a foil liner to a sealing surface of a container. For purposes of illustration only, the method 200 will be described below with reference to the container 10, apparatus 12, and foil liner 14 described above. It will be appreciated, however, that the application of the method 200 is not limited to such structure, but rather the method 200 may find applicability with any number of containers and apparatus for sealing a foil liner to the container, for example, apparatus 112 and/or other container and/or apparatus not described herein.

In the embodiment illustrated in FIG. 10, the method 200 includes a step 201 of aligning the peripheral edge of the foil liner 14 with the sealing surface 24 of the container 10, and a step 202 of aligning the sealing surface 38 of the seal head 26 with the sealing surface 24 of the container 10, wherein at least a peripheral edge of the foil liner 14 is disposed between the two sealing surfaces 24, 38.

Once the container and seal head sealing surfaces 24, 38 are aligned, the seal head 26 and the container 10 may be engaged together to form a seal between the two sealing surfaces 24, 38, and thus, the container 10 and the seal head 26. In a step 203 of the method 200, pressure may be applied to press the sealing surface 38 of the seal head 26 onto the sealing surface 24 of the container 10 to compress the foil liner 14. In an embodiment, pressure of up to 60 psi may be applied; in other embodiments, pressure in excess of 60 psi may be utilized. During or after the application of pressure in step 203, the method 200 may include a step 204 of applying heat between the seal head 26 and the container 10 to heat the foil liner 14 and container sealing surface 24 as part of the process to secure and seal the foil liner 14 to the sealing surface 24 (i.e., heat is applied to the foil liner 14 and the container sealing surface 24 by the seal head 26 using a conduction sealing technique; though induction sealing techniques may also be used as described above with respect to the seal head 126). As heat is applied during the sealing process, the head space of the container 10 located proximate the foil liner 14 (e.g., the space in the container 10 between the contents and the foil liner 14) may expand causing the foil liner 14 to bow outwardly in an axial direction relative to the container 10. As a result, the foil liner 14 may tear or wrinkles may be formed or created in the foil liner 14 which may cause a leak to occur in the seal between the foil liner 14 and the container sealing surface 24.

To prevent, or at least minimize, tearing or the formation of wrinkles in the foil liner 14 during the sealing process, the method 200 includes a step 205 of passing or forcing a fluid through the fluid path 48 in the seal head 26 and across or onto the foil liner 14. In an embodiment, the fluid passed or forced through the fluid path 48 is air (e.g., compressed air) and in such an embodiment, step 205 comprises blowing the air or other gas through the fluid path 48. In any case, passing fluid through the fluid path 48 and onto the foil liner 14 serves to cool the foil liner 14 and the head space of the container 10, and also creates an over-pressure that is applied to the foil liner 14 in an axial direction towards the container 10. Cooling the foil liner 14 and the head space of the container 10 and/or creating an over-pressure in this way serves to negate or act against the thermal expansion of the head space and/or the pressure within the head space, and thus, prevents or at least significantly minimizes, for example, the doming and/or tearing of, or the formation of wrinkles in, the foil liner 14. The fluid may be introduced into and passed through the fluid path 48 by a suitable fluid source S that is in fluid communication with the inlet passageway 44 of the seal head 26. In an embodiment, the fluid passed through the fluid path 48 is a cold fluid (e.g., cold air or gas) having a temperature on the order of 35-100° F. to maximize the cooling effect the fluid flow has on the foil liner 14 and the container head space proximate thereto; though in other embodiments, fluid at or above room temperature may utilized instead. It will be appreciated that in an embodiment, the step 205 is performed during the sealing of the foil liner 14 to the container sealing surface 24 (i.e., step 205 is performed while heat is being applied to the foil liner 14 and sealing surface 24).

In an embodiment, the method 200 may include further a step 206 of varying or adjusting the flow of the fluid being passed or forced through the fluid path 48 and onto the foil liner 14 in order to, for example, adjust the pressure applied to the foil liner 14 during sealing. This pressure may comprise one or both of the over-pressure described above that is applied to the foil liner 14 by the fluid as it flows through the fluid path 48 and over and onto the foil liner 14 (i.e., by increasing the flow, the pressure is increased, and by decreasing the flow, the pressure is decreased), and the pressure applied to the foil liner 14 as a result of the thermal expansion of the container head space (e.g., by increasing the flow, the head space may cool quicker and thus the pressure may be decreased, and by decreasing the flow, the head space may cool slower and thus the pressure may be increased). In an embodiment, the step 206 is performed during the sealing of the foil liner 14 to the container sealing surface 24 (i.e., step 206 is performed while heat is being applied to the foil liner 14 and sealing surface 24).

In addition to some or all of the steps described above, the method 200 may include further a step 208 of directing fluid across or onto the foil liner 14 following the sealing of the foil liner 14 to the container sealing surface 24 (i.e., after application of heat to the foil liner 14 and the container sealing surface 24 in step 204 has ceased) and while the foil liner 14 and the container sealing surface 24 cool. In an embodiment, step 208 comprises passing fluid through the fluid path 48 in the seal head 26 and across the foil liner 14. As with step 205 above, in an embodiment, the fluid passed through the fluid path 48 is air (e.g., compressed air) or other gas and step 208 comprises blowing the air through the fluid path 48. In any case, by passing fluid through the fluid path 48 in this way, the cooling of the foil liner 14 and the head space of container 10 is expedited and the seal between the foil liner 14 and the container sealing surface 24 is locked. More particularly, the passing of fluid through the fluid path 48 following the application of heat serves to cool the head space of the container 10, thereby eliminating, or at least minimizing, the pressure in the head space and the thermal expansion thereof that can fight against the seal and deform, tear, or cause wrinkles in the foil liner 14.

In another embodiment, step 208 may additionally or alternatively comprise blowing or passing fluid (e.g., pressurized and/or cooled air or gas, warm air or gas (e.g., around 95° F.), liquid (e.g., water), etc.) onto or across the foil liner 14 following the sealing of the foil liner 14 to the container sealing surface 24 and after the seal head 26 is disengaged from the container sealing surface 24 (i.e., after the seal head 26 and container 10 are separated from each other). By blowing fluid onto or across the foil liner 14 in this way, the cooling of the foil liner 14 and the head space of container 10 is expedited and a vacuum is formed in the container 10 to eliminate, or at least minimize, the pressure in the head space and the thermal expansion thereof that can fight against the seal and deform, tear, or cause wrinkles in the foil liner 14. In such an embodiment, step 208 may be performed by blowing fluid (e.g., air or gas) through a vortex chiller tube at a predetermined temperature for a predetermined period of time. For example, in an illustrative embodiment, the fluid may be blown through a vortex chiller tube at, for example, 38° F. for five (5) seconds. It will be appreciated, however, that other suitable fluids, fluid sources, temperatures, and durations of time may be used, and therefore, remain within the spirit and scope of the present disclosure.

There thus has been disclosed an apparatus and method for sealing a foil liner to a sealing surface of a container that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A method of sealing a foil liner to a sealing surface of a container that surrounds a mouth of the container, comprising:

aligning a sealing surface of a seal head with the sealing surface of the container, wherein at least a peripheral edge of the foil liner is disposed between the sealing surfaces of the seal head and the container;

applying heat between the seal head and the container to heat the foil liner and the sealing surface of the container, the peripheral edge of the foil liner being sealed to the sealing surface of the container and the foil liner extending across the mouth of the container; and passing fluid through one or more fluid paths in the seal head and out of the seal head and onto at least a portion of the foil liner radially inward of the peripheral edge of the foil liner.

2. The method set forth in claim 1, wherein the applying step comprises applying heat between the seal head and the container by the seal head.

3. The method set forth in claim 1, wherein the applying step comprises applying heat onto a portion of the foil liner by the seal head.

4. The method set forth in claim 1, further comprising varying the flow of the fluid through the one or more fluid paths and onto the foil liner to adjust a pressure applied to the foil liner.

5. The method set forth in claim 1, wherein the passing step is performed during the sealing of the foil liner to the sealing surface of the container.

6. The method of claim 1, further comprising passing fluid through the one or more fluid paths in the seal head and onto the foil liner following the applying step to cool a head space of the container and thus locking a seal between the foil liner and the sealing surface of the container.

7. The method of claim 1, wherein said passing step comprises blowing gas through the one or more fluid paths in the seal head and onto the foil liner.

8. The method of claim 1, further comprising separating the seal head from the container and then passing fluid onto the foil liner to cool the foil liner and a head space of the container and to cause a vacuum to form in the container.

9. The method of claim 1, wherein prior to the applying step, the method further comprises pressing the seal head and the container together to compress the peripheral edge of the foil liner.

10. The method of claim 1, wherein passing fluid through the one or more fluid paths comprises passing fluid through an inlet passageway of the seal head, onto the foil liner, and out of an outlet passageway of the seal head.

* * * * *